US008779666B2

(12) United States Patent
Ko et al.

(10) Patent No.: US 8,779,666 B2
(45) Date of Patent: Jul. 15, 2014

(54) COMPENSATION CIRCUIT FOR KEEPING LUMINANCE INTENSITY OF DIODE

(75) Inventors: Chien-Chaun Ko, Shengang Township (TW); Chao-Hui Wu, Kaohsiung (TW)

(73) Assignee: Hannstar Display Corporation, New Taipei (TW)

( * ) Notice: Subject to any disclaimer, the term of this patent is extended or adjusted under 35 U.S.C. 154(b) by 191 days.

(21) Appl. No.: 13/354,058

(22) Filed: Jan. 19, 2012

(65) Prior Publication Data

US 2013/0009550 A1 Jan. 10, 2013

(30) Foreign Application Priority Data

Jul. 8, 2011 (TW) ..... 100124392 A

(51) Int. Cl.
*H05B 37/02* (2006.01)
*G09G 3/30* (2006.01)

(52) U.S. Cl.
USPC ..... 315/151; 315/169.3; 315/291; 345/77; 345/207

(58) Field of Classification Search
USPC ..... 315/151
See application file for complete search history.

(56) References Cited

U.S. PATENT DOCUMENTS 7,612,818 B2 * 11/2009 Nakamura et al. ..... 348/308
7,859,486 B2 * 12/2010 Kwon ..... 345/66
7,944,415 B2 * 5/2011 Jang et al. ..... 345/77
7,978,187 B2 * 7/2011 Nathan et al. ..... 345/204
8,106,345 B2 * 1/2012 Kim et al. ..... 250/214 AL
2004/0252089 A1 * 12/2004 Ono et al. ..... 345/82
2005/0285826 A1 * 12/2005 Park et al. ..... 345/76
2006/0284801 A1 12/2006 Yoon et al.
2009/0206378 A1 8/2009 Kim et al.
2012/0242712 A1 * 9/2012 Ko et al. ..... 345/690
2013/0043796 A1 * 2/2013 Ko et al. ..... 315/151

FOREIGN PATENT DOCUMENTS

TW I239501 9/2005

OTHER PUBLICATIONS

"Office Action of Taiwan Counterpart Application", issued on Nov. 21, 2013, p. 1-p. 8.

* cited by examiner

*Primary Examiner* — Alexander H Taningco
*Assistant Examiner* — Nelson Correa
(74) *Attorney, Agent, or Firm* — Jianq Chyun IP Office

(57) ABSTRACT

A compensation circuit for keeping luminance intensity of a diode. The compensation circuit comprises a stabilization unit, a first transistor, a second transistor, a third transistor, a fourth transistor and an organic light emitting diode (OLED). The stabilization unit comprises a photodiode and a compensation capacitor. The second transistor is used to control the input time of data. In the operation of the OLED, the third transistor discharges or charges a node of the stabilization unit continuously to keep a voltage equal to VSS or VDD, so as to maintain the luminance intensity of the OLED.

14 Claims, 9 Drawing Sheets

COMPENSATION CIRCUIT FOR KEEPING LUMINANCE INTENSITY OF DIODE

CROSS-REFERENCE TO RELATED APPLICATION

This application claims the benefit of priority to Taiwan Patent Application No. 100124392, filed on Jul. 8, 2011, in the Taiwan Intellectual Property Office, the disclosure of which is incorporated herein in its entirety by reference.

FIELD OF THE INVENTION

The present invention relates to a compensation circuit, in particular to the compensation circuit capable of keeping the stability of the luminance of organic light-emitting diodes.

BACKGROUND OF THE INVENTION

In general, an active-matrix organic light emitting diode (AMOLED) display has the advantages of thin, lightweight, self-luminous, low driving voltage, high performance, high contrast ratio, high color saturation, quick response rate and flexibility, and thus the AMOLED display technology becomes the most promising emerging display technology after the thin film transistor liquid crystal display (TFT-LCD) technology has been introduced.

However, the brightness performance of the OLED is determined by the magnitude of current passing through the OLED, and the current must be controlled accurately to control the brightness of pixels accurately. Compared with the TFT-LCD that simply controls the voltage levels of written pixels to control the brightness of pixels, the OLED involves a higher level of difficulty.

In fact, the AMOLED has also encountered many problems. With reference to FIGS. 1 and 2 for schematic circuit diagrams of a p-type transistor and an n-type transistor of the AMOLED without compensation respectively, the current $I_{OLED}$ of the OLED is converted from data voltage $V_{DATA}$ by using the thin film transistor (TFT) T2 operated in a saturated region. For the n-type T2, the formula is $IOLED=\frac{1}{2}*W/L*\mu_N*C_{OX}(V_{GS}-V_{TH})^2$, wherein after operating the AMOLED for a long time, the $V_{TH}$ of the TFT T2 will increase and the mobility $\mu_N$ will decrease, so that the $I_{OLED}$ will drop and cause the brightness of the OLED to decrease.

Furthermore, due to the material aging and the long-time operation of the OLED, the problems of a gradually increased voltage drop across the OLED and a decreased luminous efficiency may occur. The increase of voltage drop across the OLED may effect the operation of the TFT. As to the n-type TFT, if the OLED is coupled to a source of the n-type TFT, and the voltage drop across the OLED increases, both of the voltage between the source and the drain of TFT and the passing current will be affected directly. As to the luminous efficiency, the material aging and the intensity drop caused by the long-time operation will fail to produce the expected intensity even when a constant current is passed. If the luminous efficiencies of the red (R), green (G) and blue (B) colors drop differently, a color shift will occur. However, this problem cannot be solved easily, since improvement of the material cannot be made easily.

As the size of panels becomes larger and the length of the signal lines becomes increasingly longer, the internal resistance effect becomes more significant, and affects a uniform luminous efficiency of the panel, and such phenomenon is called an I-R Drop. With reference to FIG. 3 for a schematic view of the I-R Drop, the signal lines of VDD and VSS generate a dropout voltage by the internal resistance effect, so that the pixels disposed at different positions of the AMOLED panel have different currents that affect the uniform luminous efficiency of the panel.

SUMMARY OF THE INVENTION

In view of the above-mentioned problems, it is a primary object of the invention to overcome the problems by providing a compensation circuit for keeping luminance intensity of a diode to solve the problems such as luminous efficiency drop and decreased luminance intensity of the OLED caused by the drop of the OLED current IOLED.

To achieve the aforementioned objective, the present invention provides a compensation circuit for keeping luminance intensity of a diode, and the compensation circuit comprises a stabilization unit, a first transistor, a second transistor, a third transistor, a fourth transistor and a light emitting diode. The stabilization unit comprises a photodiode and a capacitor. An end of the stabilization unit is a first node, the other end is a second node, and a third node is disposed between the photodiode and the capacitor. The first transistor is coupled to a first power supply, a first control signal and the first node. The second transistor is coupled to a second power supply, the first control signal and the second node. The third transistor is coupled to a third power supply, a second control signal and the third node. The light emitting diode is coupled to the third power supply and a fourth transistor. The fourth transistor is coupled to the first transistor and the light emitting diode, such that the fourth transistor can be turned on to conduct the light emitting diode.

Wherein, the first transistor is a first p-type thin-film transistor and the second transistor is a second p-type thin-film transistor, and the third transistor is a first n-type thin-film transistor and the fourth transistor is a second n-type thin-film transistor.

Wherein, the second p-type thin-film transistor controls the input time of the second power supply.

Wherein, the first n-type thin-film transistor charges the third node continuously to maintain a potential equal to that of the third power supply at the light emitting stage of the light emitting diode.

Wherein, the capacitor stores a potential difference generated by an increased resistance value of the photodiode.

Wherein, the first transistor is a first n-type thin-film transistor and the second transistor is a second n-type thin-film transistor, and the third transistor is a first p-type thin-film transistor and the fourth transistor is a second p-type thin-film transistor.

Wherein, the second n-type thin-film transistor stores the input time of the second power supply.

Wherein, the first p-type thin-film transistor charges the third node continuously to maintain a potential equal to that of the third power supply at a light emitting stage of the light emitting diode.

In the description above, the present invention provides a compensation circuit for keeping luminance intensity of a diode to solve the problems of decreased luminous efficiency and decreased luminance intensity of the OLED caused by the drop of the OLED current IOLED, and maintains the stability of the brightness of the OLED.

DESCRIPTION OF THE PREFERRED EMBODIMENTS

The present invention will be apparent from the following detailed description, which proceeds with reference to the accompanying drawings, wherein the same references relate to the same elements.

Figure 1:
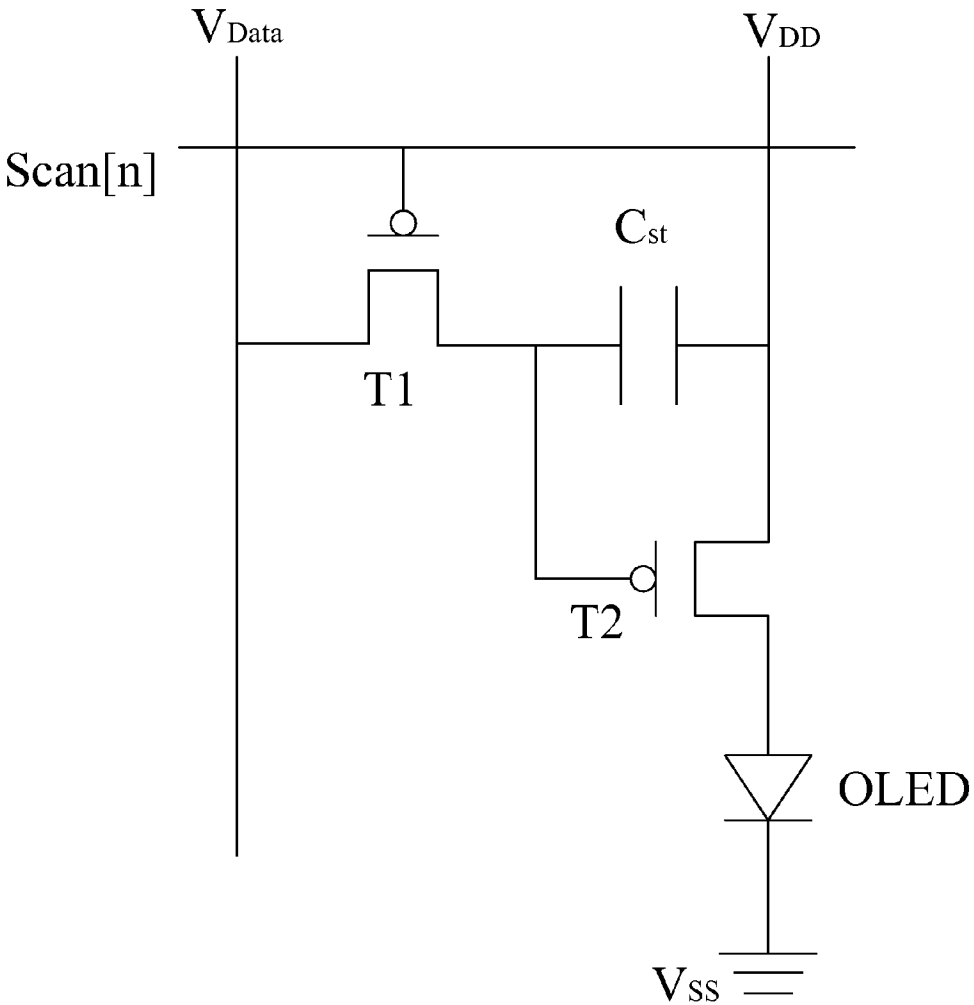
FIG. 1 (PRIOR ART)
FIG. 1 is a schematic circuit diagram of a p-type transistor of an AMOLED without compensation.
Figure 2:
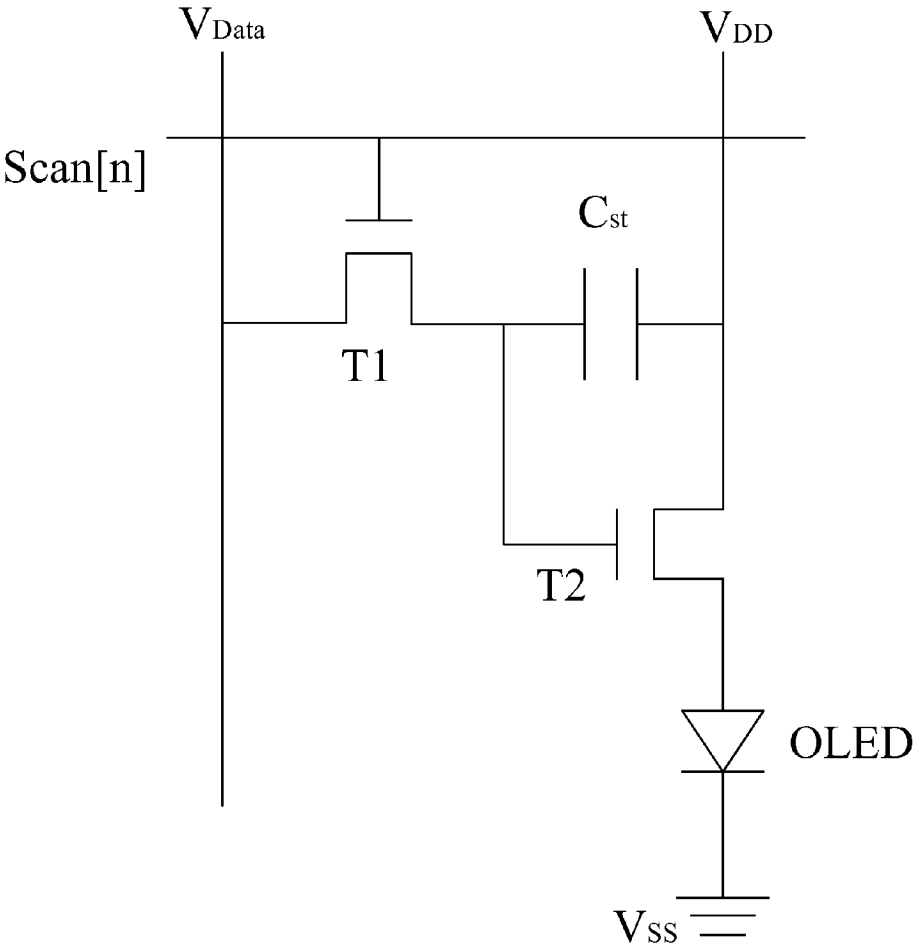
FIG. 2 (PRIOR ART)
FIG. 2 is a schematic circuit diagram of an n-type transistor of AMOLED without compensation.
Figure 3:
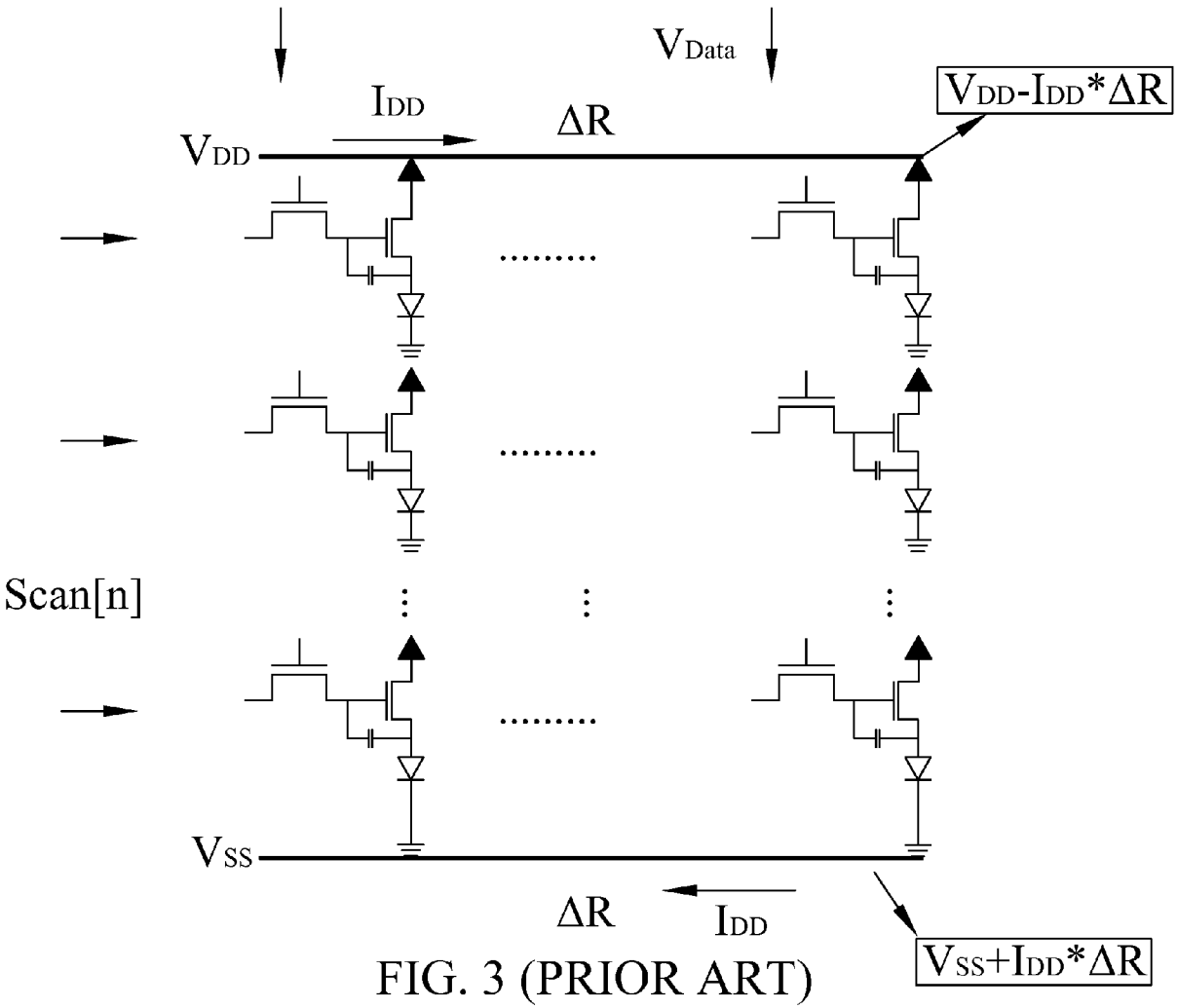
FIG. 3 (PRIOR ART)
FIG. 3 is a schematic view of an I-R drop.
Figure 4:
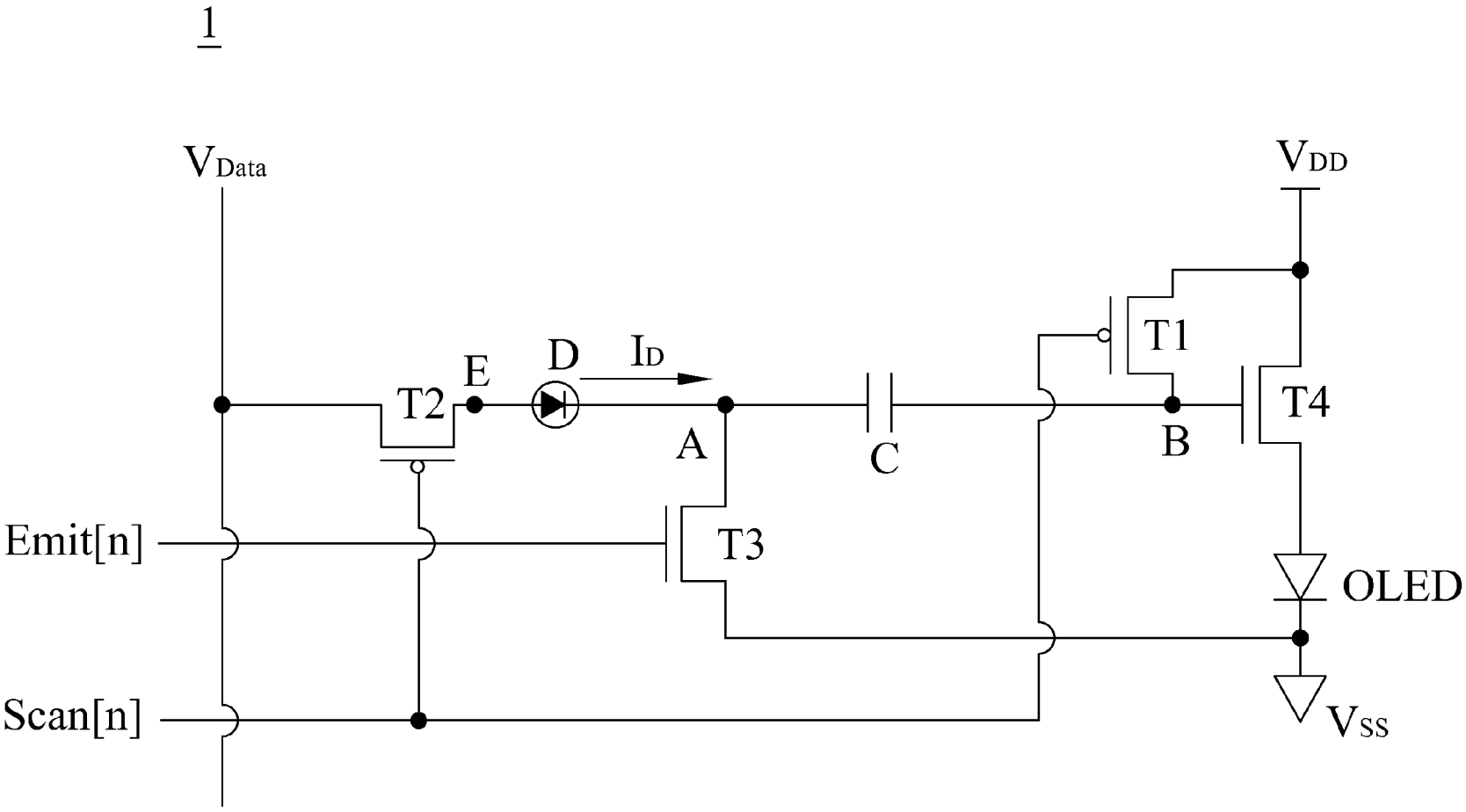
FIG. 4 is a schematic circuit diagram of a compensation circuit for keeping luminance intensity of a diode in accordance with the first preferred embodiment of the present invention.

With reference to FIG. 4 for a schematic circuit diagram of a compensation circuit for keeping luminance intensity of a diode in accordance with the first preferred embodiment of the present invention, the compensation circuit 1 comprises two p-type thin-film transistors (TFT) T1, T2, two n-type thin-film transistors (TFT) T3, T4, a photodiode D and a capacitor C. In this embodiment, the compensation circuit 1 further comprises two control signals Emit[n] and Scan[n], and three power signals $V_{DD}$, $V_{SS}$ and $V_{Data}$. Wherein the n-type TFT T4 is used to drive an organic light emitting diode (OLED), and the TFTs T1 to T3 are used as switches, and the capacitor C is used for the compensation.

In all of the TFTs which serve as the switches, the n-type TFT T4 can be formed in a diode-connection and conduct by the p-type TFT T1 in a data writing stage. When the above-mentioned factors for decreasing the luminance intensity of OLED occur, it will cause a deterioration of the luminance intensity of OLED, so that the resistance value of the photodiode D (and the function of the photodiode D is the same as a light-sensitive resistor in this embodiment) in the pixels may increase and affect the actual voltage written into the pixels which is stored in the compensation capacitor C. The p-type TFT T2 serves as a switch for a general pixel circuit to control a data input time. The n-type TFT T3 is used to charge node A to $V_{SS}$ continuously when the pixels of the AMOLED are situated at a light emitting stage. Since node A is kept at $V_{SS}$ instead of being at a floating state, therefore node A will not change as the $V_{Data}$ varies and be affected by the leakage current of the p-type TFT T2. As a result, the pixels can keep a potential of the node A without requiring the $C_{st}$ adopted in the prior art.

Figure 5:
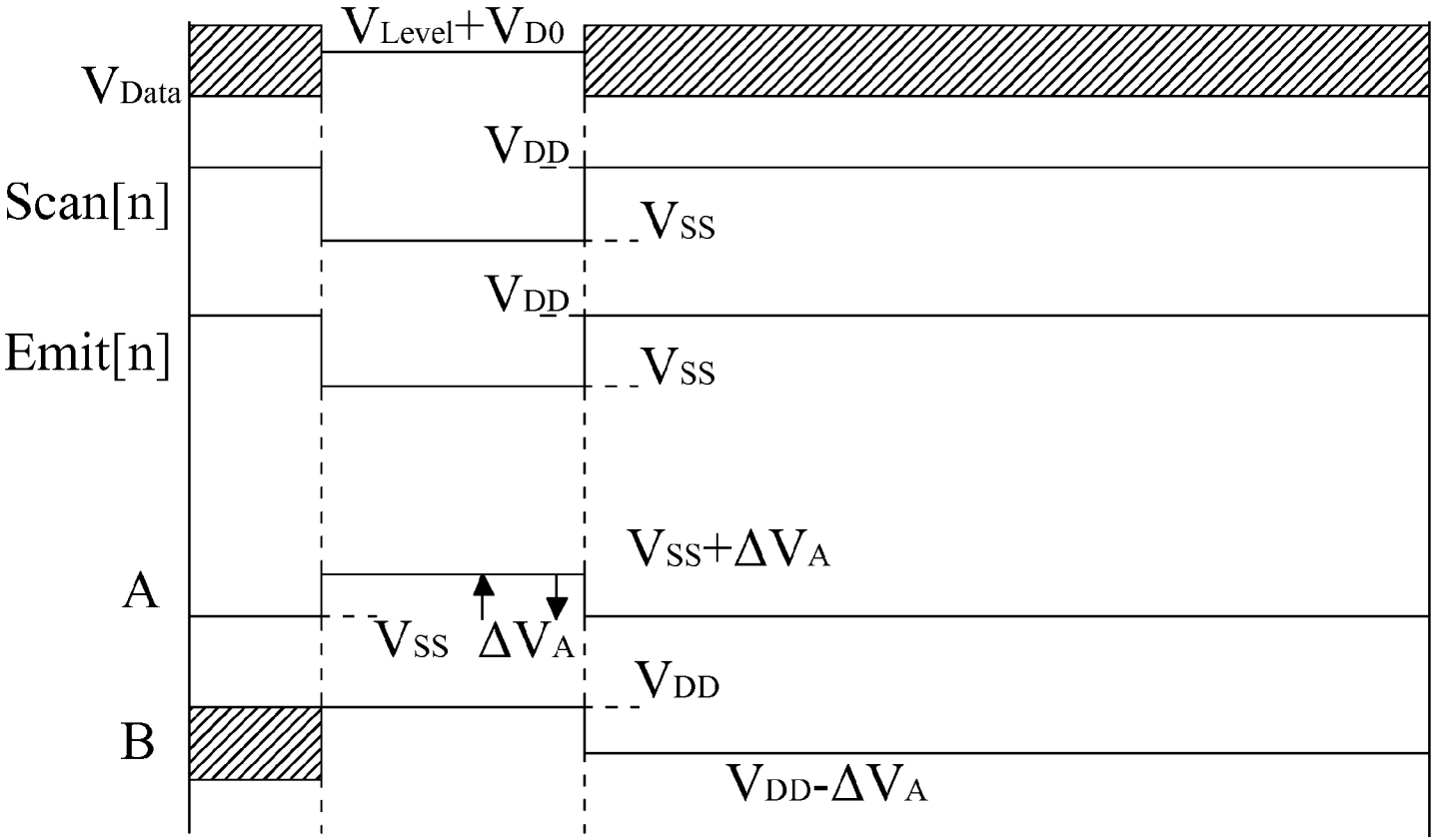
FIG. 5 is a signal waveform diagram of a compensation circuit for keeping luminance intensity of a diode in accordance with the first preferred embodiment of the present invention.

With reference to FIG. 5 for a signal waveform diagram of a compensation circuit for keeping luminance intensity of a diode according to the first embodiment of the present invention, there are two stages in the operation of the compensation in this embodiment.

The first stage is to detect a luminance intensity of the OLED to adjust the potential of written pixel data:

TFTs T1, T2, T4 are conducted by signals Scan[n] and Emit[n], and T3 is turned off when the potential of node B $V_B$ is $V_{DD}$. The potential $V_A$ of the node A ranges from $V_{SS}$ to $V_{SS}+\Delta V_A$ (in this embodiment, $\Delta V_A$ is positive) while the original state of the brightness of OLED is the brightest and the resistance value of the photodiode D (in this embodiment, the efficiency of the photodiode D is the equal to that of a light-sensitive resistor) in pixels is equalized to $R_D$. If the value of written data voltage $V_{Data}=V_{Level}+V_{D0}+V_{SS}$ (in this embodiment, $V_{D0}$ is the voltage drop across the photodiode as the current value of the photodiode D is zero), the equation for the data scan time $T=2R_DC$ (which is the time used for conducting the TFTs T1, T2 and T4 by Scan[n]), so that the formula of $\Delta V_A$ is given below:

$$\Delta V_A = \frac{\int_0^T I_D \cdot dt}{C} = \frac{\frac{1}{2}\cdot T\cdot\frac{V_{Data}-VSS-V_{D0}}{R_D}}{C} = \frac{\frac{1}{2}\cdot T\cdot\frac{V_{Level}}{R_D}}{C} = V_{Level}$$

Wherein, the time of all gray scale written voltages (wherein the minimal value of $V_{Level}$ is σ and greater than 0, and σ is a constant) is $2R_DC$.

Figure 6:
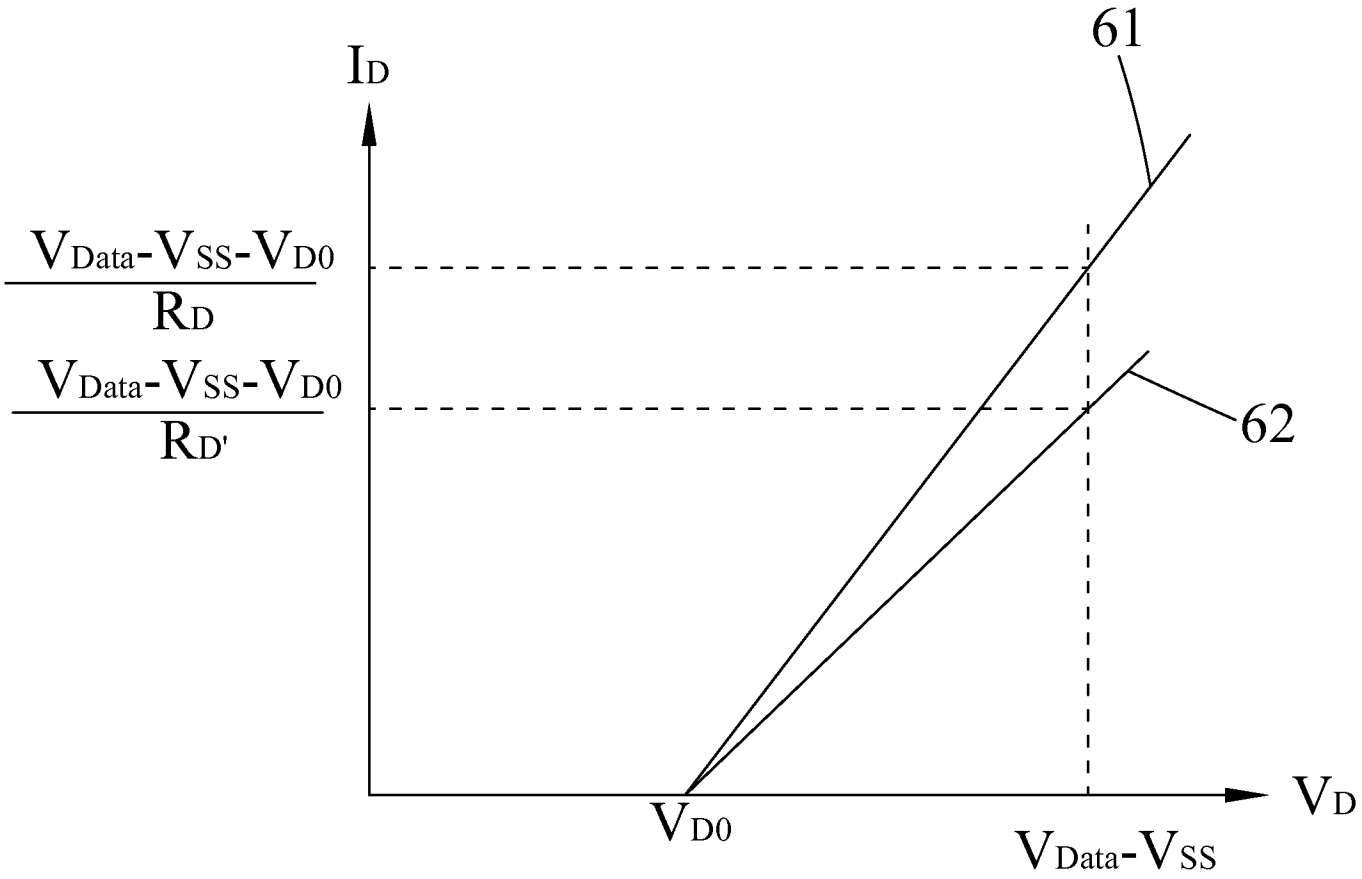
FIG. 6 is a schematic view of a diode forward characteristic in accordance with the first preferred embodiment of the present invention.

With reference to FIG. 6 for a schematic view of a diode forward characteristic according to the first embodiment of the present invention, if the above-mentioned factors for deteriorating the $I_{OLED}$ causes a decreased luminance intensity of OLED, the resistance value of light-sensitive resistor will be increased from $R_D$ to $R_{D'}$, and the potential of node A $V_A'$ will be changed from $V_{SS}$ to $V_{SS}+\Delta V_{A'}$. Wherein, the slope of the oblique line 61 is $1/R_D$, and the slope of the oblique line 62 is $1/R_{D'}$. The formula of $\Delta V_{A'}$ as below:

$$\Delta V_A' = \frac{\int_0^T I_D' \cdot dt}{C} = \frac{\frac{1}{2}\cdot T\cdot\frac{V_{Data}-VSS-V_{D0}}{R_D'}}{C} = \frac{R_D}{R_D'}V_{Level}$$

The next stage is a light emitting display of the OLED, described as follows:

The TFTs T1 and T2 are turned off by signals Scan[n] and Emit[n], and the TFT T3 is conducted while node B is at a floating state. The potential $V_A$ of node A is changed from $V_{SS}+\Delta V_A$ to $V_{SS}$, and the variation is $-\Delta V_A$. The equation of the potential $V_B$ of node B is changed to $V_{DD}-\Delta V_A=V_{DD}-V_{Level}$ by the capacitive coupling effect of node A, wherein $V_{L0}$ is equal to $V_{DD}$, and $V_{L255}$ is equal to σ.

When the above-mentioned factors for deteriorating the $I_{OLED}$ Occur, the potential $V_{A'}$ of node A is changed from $V_{SS}+\Delta V_{A'}$ to $V_{SS}$, and the variation is $-\Delta V_{A'}$, and the equation of the potential $V_{B'}$ of node B is changed to $V_{DD}-\Delta V_A=V_{DD}-R_D/R_{D'}*V_{Level}$ by the capacitive coupling effect of node A, so that $V_{B'}$ is greater than $V_B$. Regardless of the written gray scale voltage $V_{Level}$, the gate voltage of the n-type TFT T4 is increased to achieve the compensation effect.

As to the I-R Drop, the signal input terminals of $V_{DD}$ and $V_{SS}$ are changed to $V_{DD}-I*R$ and $V_{SS}+I*R$ respectively as the pixels of AMOLED are disposed at positions far away. The equation of the potential $V_B$ of node B is changed to $(V_{DD}-I*R)-\Delta V_A=(V_{DD}-I*R)-(V_{Level}-I*R)=V_{DD}-V_{Level}$ by the capacitive coupling effect of node A, and the potential is equal to the pixels of the AMOLED proximate to the signal input terminals of $V_{DD}$ and $V_{SS}$, and thus not affected by the I-R Drop effect. The formula of $\Delta V_A$ is given below:

$$\Delta V_A = \frac{\int_0^T I_D \cdot dt}{C} = \frac{\frac{1}{2}\cdot T\cdot\frac{V_{Data}-(VSS+I*R)-V_{D0}}{R_D}}{C} = \frac{\frac{1}{2}\cdot T\cdot\frac{V_{Level}-I*R}{R_D}}{C} = V_{Level}-I*R$$

Figure 7:
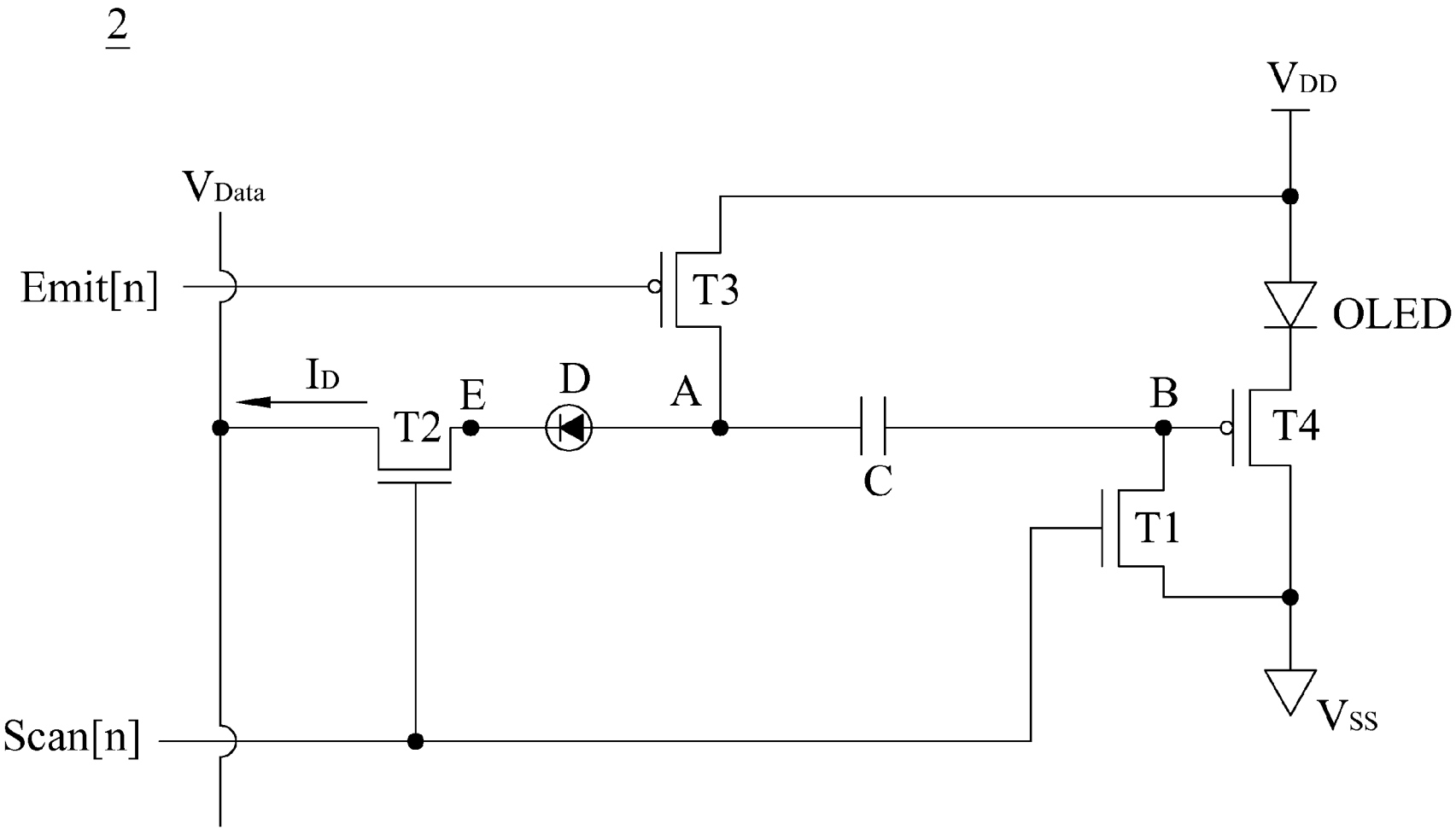
FIG. 7 is a schematic circuit diagram of a compensation circuit for keeping luminance intensity of a diode in accordance with the second preferred embodiment of the present invention.

With reference to FIG. 7 for a schematic circuit diagram of a compensation circuit for keeping luminance intensity of a diode according to the second embodiment of the present invention, the compensation circuit 2 comprises two p-type thin-film transistors (TFT) T3, T4, two n-type thin-film transistors (TFT) T1, T2, a photodiode D and a capacitor C. In this embodiment, the compensation circuit further comprises two control signals Emit[n] and Scan[n], and three power signals $V_{DD}$, $V_{SS}$ and $V_{Data}$, wherein T4 is used to drive an organic light emitting diode (OLED), T1 to T3 serve as switches, and the capacitor C is used for the compensation.

In all of the TFTs which serve as switches, the TFT T4 is formed by a diode-connection and conduct by the TFT T1 in a data writing stage. When the above-mentioned factors for deteriorating the luminance intensity of OLED occur to cause a decreased luminance intensity of OLED, the resistance value of the photodiode D (the efficiency of the photodiode D is the same as a light-sensitive resistor as the embodiment) in pixels may increase and affect the actual value of voltage written into the pixels and stored in the compensation capacitor C. The TFT T2 serves as a switch for a general pixel circuit to control the data input time. The TFT T3 is used to charge node A to $V_{DD}$ continuously during the light emitting stage of the pixels in the AMOLED. Since node A is kept at $V_{DD}$ without being at a floating state, node A cannot be changed as the $V_{Data}$ varies and be affected by the leakage current of the TFT T2. Thus, the pixels can keep the potential of node A without requiring $C_{st}$ as adopted in the prior art.

Figure 8:
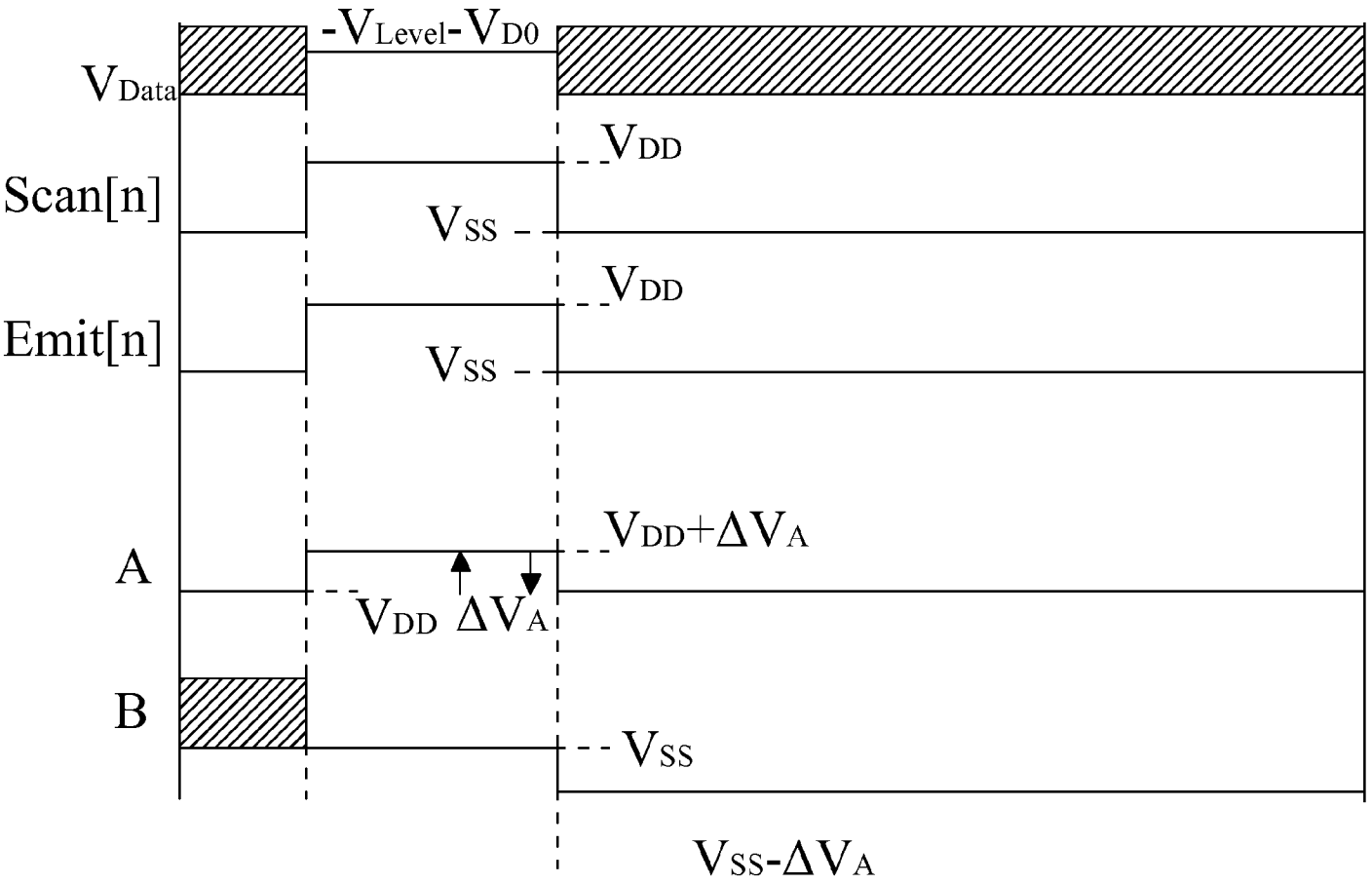
FIG. 8 is a signal waveform diagram of a compensation circuit for keeping luminance intensity of a diode in accordance with the second preferred embodiment of the present invention.

With reference to FIG. 8 for a signal waveform diagram of a compensation circuit for keeping luminance intensity of a diode according to the second embodiment of the present invention, there are two stages in the operation of the compensation in this embodiment.

In the first stage, the luminance intensity of the OLED is detected to adjust the potential of written pixel data.

The TFTs T1, T2, T4 are conducted by the signals Scan[n] and Emit[n], and the TFT T3 is turned off when the potential of node B $V_B$ is equal to $V_{SS}$. The potential $V_A$ of node A is changed from $V_{DD}$ to $V_{DD}+\Delta V_A$ (in this embodiment, $\Delta V_A$ is negative), and the original state of brightness of OLED is brightest and the resistance value of photodiode D (in this embodiment, the efficiency of the photodiode D is the same as a light-sensitive resistor) in pixels is equal to $R_D$. If the value of written data voltage $V_{Data}$ is equal to $V_{DD}-V_{Level}-V_{D0}$ (in this embodiment, $V_{D0}$ is the voltage drop across the photodiode when the current value of the photodiode D is zero), the equation for the data scan time $T=2R_DC$ (which is the time for conducting the T1, T2 and T4 by the Scan[n]), and the formula of ΔVA is given below:

$$\Delta V_A = \frac{\int_0^T -I_D \cdot dt}{C} = -\frac{\frac{1}{2}\cdot T\cdot\frac{V_{DD}-V_{Data}-V_{D0}}{R_D}}{C} = -\frac{\frac{1}{2}\cdot T\cdot\frac{V_{Level}}{R_D}}{C} = -V_{Level}$$

Wherein, the time of all written gray scale voltages is $2R_DC$ (wherein the minimal value of $V_{Level}$ is σ and greater than 0, and σ is a constant).

Figure 9:
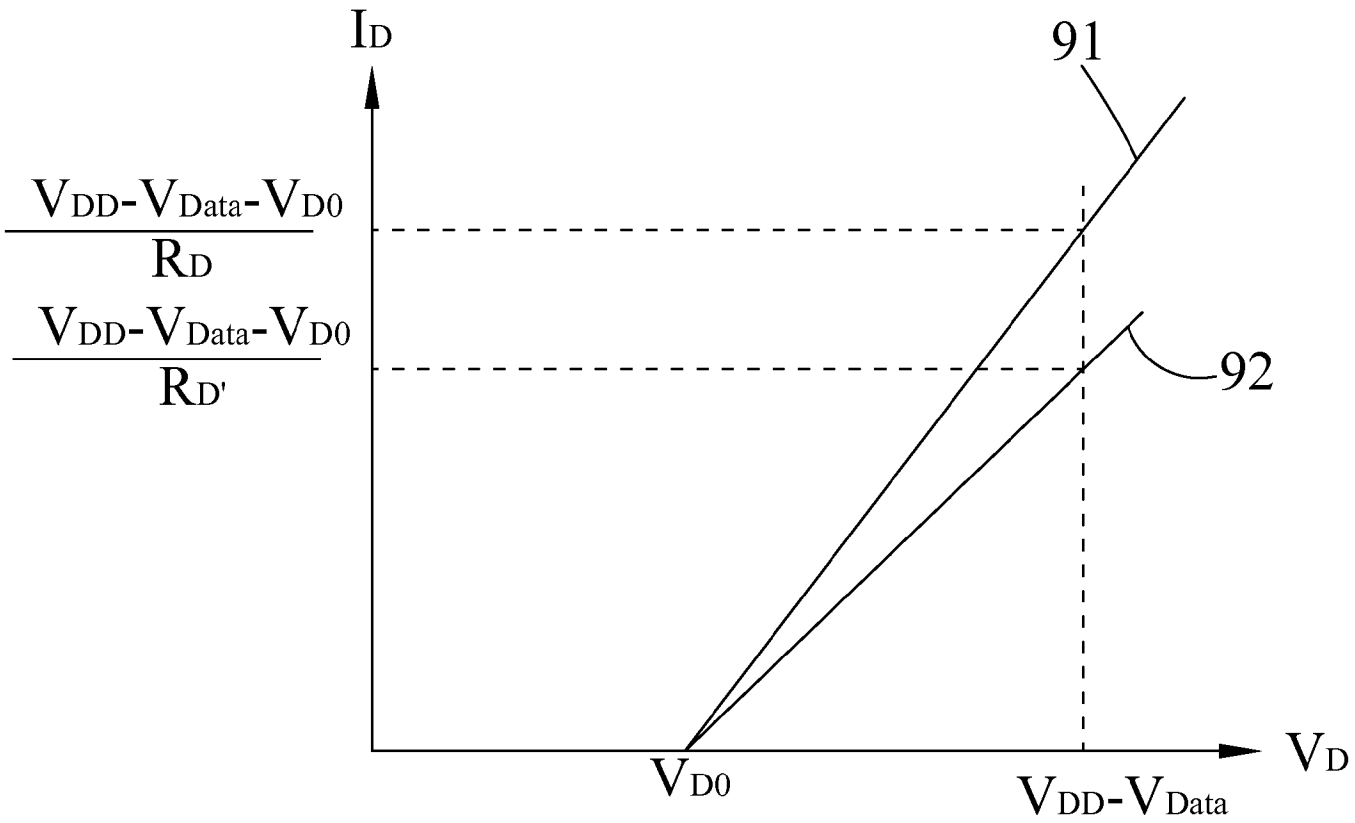
FIG. 9 is a schematic view of a diode forward characteristic in accordance with the second embodiment of the present invention.

With reference to FIG. 9 for a schematic view of a diode forward characteristic according to the second embodiment of the present invention, when the above-mentioned factors for deteriorating the $I_{OLED}$ occurs to decrease the luminance intensity of OLED, the resistance value of the light-sensitive resistor is increased from $R_D$ to $R_{D'}$, and the potential $V_{A'}$ of node A is changed from $V_{DD}$ to $V_{DD}+\Delta V_{A'}$. Wherein, the slope of the oblique line 91 is $1/R_D$, and the slope of the oblique line 92 is $1/R_{D'}$. The formula of $\Delta V_{A'}$ is given below:

$$\Delta V'_A = \frac{\int_0^T -I'_D \cdot dt}{C} = -\frac{\frac{1}{2}\cdot T\cdot\frac{V_{DD}-V_{Data}-V_{D0}}{R'_D}}{C} = -\frac{R_D}{R'_D}V_{Level}$$

The next stage is a light emitting display of the OLED, described as follows:

The TFTs T1, T2, are turned off by the signals Scan[n] and Emit[n], and the T3 is conducted when node B is situated at a floating state. The potential $V_A$ of node A is changed from $V_{DD}+\Delta V_A$ to $V_{DD}$, and the variation is $-\Delta V_A$. The equation of the potential $V_B$ of node B is changed to $V_{SS}-\Delta V_A=V_{SS}+V_{Level}$ by the capacitive coupling effect of node A, wherein $V_{L0}$ is equal to $V_{DD}$ and $V_{L255}$ is equal to σ.

When the above-mentioned factors for deteriorating the $I_{OLED}$ occur to decrease the luminance intensity of the OLED, the potential $V_{A'}$ of node A is changed from $V_{DD}+\Delta V_{A'}$ to $V_{DD}$, and the variation is $-\Delta V_{A'}$, and the equation of the potential $V_{B'}$ of node B is changed to $V_{SS}-\Delta V_{A'}=V_{SS}+R_D/R_{D'}*V_{Level}$ by the capacitive coupling effect of node A, so that $V_{B'}$ is smaller than $V_B$. Regardless of the written gray scale voltage $V_{Level}$, the gate voltage of the n-type TFT T4 becomes smaller to achieve compensation effect.

As to the I-R drop, the signal input terminals of $V_{DD}$ and $V_{SS}$ are changed to $V_{DD}-I*R$ and $V_{SS}+I*R$ respectively when the pixels of the AMOLED are disposed far away. The equation of the potential $V_B$ of node B is changed to $(V_{SS}+I*R)-\Delta V_A=(V_{SS}+I*R)-(-V_{Level}+I*R)=V_{SS}+V_{Level}$ by the capacitive coupling effect of node A, and the potential is equal to that of the pixels of the AMOLED proximate to the signal input terminals of $V_{DD}$ and $V_{SS}$ and is not be affected by I-R Drop effect. The formula of $\Delta V_A$ is given below:

$$\Delta V_A = \frac{\int_0^T -I_D \cdot dt}{C} = -\frac{\frac{1}{2}\cdot T\cdot\frac{(VDD-I*R)-V_{Data}-V_{D0}}{R_D}}{C} = -\frac{\frac{1}{2}\cdot T\cdot\frac{V_{Level}-I*R}{R_D}}{C} = -V_{Level}+I*R$$

In summation of the description above, the compensation circuit for keeping luminance intensity of a diode of the present invention can solve the problems including a decreased luminous efficiency, a decreased luminance intensity of an OLED due to a drop of an OLED current $I_{OLED}$, so that the invention can maintain the stability of the brightness of the OLED.

While particular embodiments of the present invention have been shown and described, it will be obvious to those skilled in the art that, based upon the teachings herein, changes and modifications may be made without departing from this invention and its broader aspects. Therefore, the appended claims are intended to encompass within their scope of all such changes and modifications as are within the true spirit and scope of the exemplary embodiments of the present invention.

What is claimed is:

1. A compensation circuit for keeping luminance intensity of a diode, comprising:

a first transistor, coupled to a first power supply, a first control signal and a first node;

a second transistor, coupled to a second power supply, the first control signal and a second node;

a stabilization unit comprising a photodiode and a capacitor both connected in series between the first node and second node;

a third transistor, coupled to a third power supply, a second control signal and a common node between the photodiode and the capacitor;

a light emitting diode, having a first terminal coupled to the third power supply and coupled to the common node between the photodiode and the capacitor through the third transistor; and a fourth transistor, coupled to the first node, the first power supply and a second terminal of the light emitting diode, wherein the fourth transistor is turned on to conduct the light emitting diode.

2. The compensation circuit for keeping luminance intensity of a diode according to claim 1, wherein the first and second transistors are first and second p-type thin-film transistors respectively, the third and fourth transistors are first and second n-type thin-film transistors respectively.

3. The compensation circuit for keeping luminance intensity of a diode according to claim 2, wherein a first terminal of the capacitor is coupled to a current output terminal of the photodiode to form the common node, and a second terminal of the capacitor is coupled to the first node, and a current input terminal of the photodiode is coupled to the second node.

4. The compensation circuit for keeping luminance intensity of a diode according to claim 3, wherein the first p-type thin-film transistor includes a source coupled to the first power supply, a gate coupled to the first control signal, and a drain coupled to a gate of the second n-type thin-film transistor and the first node, wherein the first power supply is a $V_{DD}$ power signal.

5. The compensation circuit for keeping luminance intensity of a diode according to claim 3, wherein the second p-type thin-film transistor includes a source coupled to the second power supply, a gate coupled to the first control signal, and a drain coupled to the current input terminal of the photodiode and the second node, wherein the second power supply is a $V_{Data}$ power signal, wherein the second p-type thin-film transistor controls an input time of the second power supply in response to the first control signal.

6. The compensation circuit for keeping luminance intensity of a diode according to claim 3, wherein the first n-type thin-film transistor includes a drain coupled to the common node between the photodiode and the capacitor, a gate coupled to the second control signal, and a source coupled to the third power supply, wherein the third power supply is a Vss power signal, wherein the first n-type thin-film transistor is turned on in response to the second control signal at a light emitting stage of the light emitting diode, so as to continuously discharge to the common node between the photodiode and the capacitor, such that a potential of the common node is maintained equal to that of the third power supply.

7. The compensation circuit for keeping luminance intensity of a diode according to claim 3, wherein the second n-type thin-film transistor includes a drain coupled to the first power supply, a gate coupled to the first node, and a source coupled to the second terminal of the light emitting diode, wherein the first power supply is a $V_{DD}$ power signal, wherein the first terminal of the light emitting diode is a cathode of the light emitting diode, and the second terminal of the light emitting diode is an anode of the light emitting diode.

8. The compensation circuit for keeping luminance intensity of a diode according to claim 1, wherein the first and second transistors are first and second n-type thin-film transistors respectively and the third and fourth transistors are first and second p-type thin-film transistors respectively.

9. The compensation circuit for keeping luminance intensity of a diode according to claim 8, wherein a first terminal of the capacitor is coupled to a current input terminal of the photodiode to form the common node, and a second terminal of the capacitor is coupled to the first node, and a current output terminal of the photodiode is coupled to the second node.

10. The compensation circuit for keeping luminance intensity of a diode according to claim 9, wherein the first n-type thin-film transistor includes a drain coupled to the first node and a gate of the second p-type thin-film transistor, a gate coupled to the first control signal, and a source coupled to the first power supply, wherein the first power supply is a Vss power signal.

11. The compensation circuit for keeping luminance intensity of a diode according to claim 9, wherein the second n-type thin-film transistor includes a drain coupled to the second power supply, a gate coupled to the first control signal, and a source coupled to the current output terminal of the photodiode and the second node, wherein the second power supply is a $V_{Data}$ power signal, wherein the second n-type thin-film transistor controls an input time of the second power supply in response to the first control signal.

12. The compensation circuit for keeping luminance intensity of a diode according to claim 9, wherein the first p-type thin-film transistor includes a source coupled to the third power supply, a gate coupled to the second control signal, and a drain coupled to the common node between the photodiode and the capacitor, wherein the third power supply is a $V_{DD}$ power signal, wherein the first p-type thin-film transistor is turned on in response to the second control signal at a light emitting stage of the light emitting diode, so as to continuously charge to the common node between the photodiode and the capacitor, such that a potential of the common node is maintained equal to that of the third power supply.

13. The compensation circuit for keeping luminance intensity of a diode according to claim 9, wherein the second p-type thin-film transistor includes a source coupled to the second terminal of the light emitting diode, a gate coupled to the first node, and a drain coupled to the first power supply, wherein the first power supply is a Vss power signal, wherein the first terminal of the light emitting diode is an anode of the light emitting diode, and the second terminal of the light emitting diode is a cathode of the light emitting diode.

14. The compensation circuit for keeping luminance intensity of a diode according to claim 1, wherein the capacitor stores a potential difference produced by increasing a resistance value of the photodiode.

* * * * *